US010411342B2

(12) United States Patent
Nakamoto et al.

(10) Patent No.: US 10,411,342 B2
(45) Date of Patent: Sep. 10, 2019

(54) PLANAR ANTENNA DEVICE

(71) Applicants: Kabushiki Kaisha Toshiba, Minato-ku (JP); Toshiba Infrastructure Systems & Solutions Corporation, Kawasaki-shi (JP)

(72) Inventors: Masaki Nakamoto, Suginami (JP); Hirotaka Mitsushio, Sunto Shizuoka (JP); Noriyuki Saito, Kawasaki Kanagawa (JP); Youichi Kitamura, Tokyo (JP)

(73) Assignees: Kabushiki Kaisha Toshiba, Minato-ku (JP); Toshiba Infrastructure Systems & Solutions Corporation, Kawasaki-shi (JP)

( * ) Notice: Subject to any disclaimer, the term of this patent is extended or adjusted under 35 U.S.C. 154(b) by 70 days.

(21) Appl. No.: 15/855,505

(22) Filed: Dec. 27, 2017

(65) Prior Publication Data

US 2018/0123237 A1 May 3, 2018

Related U.S. Application Data

(63) Continuation of application No. PCT/JP2016/064592, filed on May 17, 2016.

(30) Foreign Application Priority Data

Jul. 2, 2015 (JP) ..... 2015-133631

(51) Int. Cl.
*H01Q 1/12* (2006.01)
*H01Q 3/08* (2006.01)
(Continued)

(52) U.S. Cl.
CPC ..... *H01Q 3/08* (2013.01); *H01Q 1/08* (2013.01); *H01Q 1/125* (2013.01);
(Continued)

(58) Field of Classification Search
CPC ..... H01Q 3/08; H01Q 1/08; H01Q 1/125; H01Q 9/04; H01Q 9/0407; H01Q 1/12; H01Q 1/1235; H01Q 21/061
See application file for complete search history.

(56) References Cited

U.S. PATENT DOCUMENTS 3,296,621 A * 1/1967 Lapp ..... H01Q 3/08 343/765
4,598,297 A * 7/1986 Hawkins ..... H01Q 1/125 343/882
(Continued)

FOREIGN PATENT DOCUMENTS

JP 02-072032 U 6/1990
JP 08-250919 9/1996
(Continued)

OTHER PUBLICATIONS

International Search Report dated Aug. 2, 2016 in PCT/JP2016/064592 filed May 17, 2016 (with English Translation).
(Continued)

*Primary Examiner* — Tho G Phan
(74) *Attorney, Agent, or Firm* — Oblon, McClelland, Maier & Neustadt, L.L.P.

(57) ABSTRACT

According to one embodiment, a planar antenna device includes a support portion, a first plate-shaped movable portion, a second plate-shaped movable portion, a third plate-shaped movable portion, and a pair of plate-shaped antenna units. The support portion is formed to have a plate shape. The first plate-shaped movable portion is supported by the support portion and is rotatable around a first axial line. The second plate-shaped movable portion is supported by the first plate-shaped movable portion and is rotatable around a second axial line. The third plate-shaped movable portion is supported by the second plate-shaped movable portion and is rotatable around a third axial line. The pair of
(Continued)

plate-shaped antenna units is turnably supported by the third plate-shaped movable portion and is switchable between a closed state and an open state.

7 Claims, 8 Drawing Sheets

(51) Int. Cl.
*H01Q 1/08* (2006.01)
*H01Q 9/04* (2006.01)
*H01Q 21/06* (2006.01)

(52) U.S. Cl.
CPC ..... *H01Q 1/1235* (2013.01); *H01Q 9/0407* (2013.01); *H01Q 21/061* (2013.01)

(56) References Cited

U.S. PATENT DOCUMENTS 4,652,890 A * 3/1987 Crean ..... H01Q 1/125 248/185.1
4,841,309 A * 6/1989 Burr ..... H01Q 1/125 343/766
5,999,139 A * 12/1999 Benjamin ..... H01Q 1/1257 343/757
6,031,508 A * 2/2000 Ishizuka ..... H01Q 1/125 343/878
9,172,128 B2 * 10/2015 O. Horth ..... H01Q 3/08
10,199,734 B2 * 2/2019 Eom ..... H01Q 1/12
2007/0217133 A1 9/2007 Tanaka et al.

FOREIGN PATENT DOCUMENTS

JP 2001-102830 4/2001
JP 2007-249902 9/2007
JP 2008-277984 11/2008
JP 2012-054814 3/2012
WO WO 2008/141772 A1 11/2008

OTHER PUBLICATIONS

Written Opinion dated Aug. 2, 2016 in PCT/JP2016/064592 filed May 17, 2016.

* cited by examiner

PLANAR ANTENNA DEVICE

CROSS-REFERENCE TO RELATED APPLICATION

This is a Continuation Application of International Application PCT/JP2016/064592, filed on May 17, 2016, which claims priority to Japanese Patent Application No. 2015-133631, filed on Jul. 2, 2015, and the entire contents of all of which are incorporated herein by reference.

FIELD

Embodiments described herein relate generally to a planar antenna device.

BACKGROUND

Communication systems performing communication via a communication satellite are less likely to be affected by a disaster such as an earthquake. Therefore, such communication systems are subjected to various reviews, as systems which can be utilized even at the time of a disaster. As a communication system of such a type, for example, there is a very small aperture terminal (VSAT) system.

In the VSAT system, an antenna device controlling communication with a communication satellite includes an antenna unit, an antenna support structure (operating) unit, an outdoor unit (ODU), and an indoor unit (IDU).

The antenna device is large in size and weight in its entirety. Therefore, for example, when the antenna device is carried to a disaster-stricken area by hand or the like, a user disassembles the antenna device into the antenna unit, the antenna support structure unit, and the like and carries the disassembled units.

However, in a case where the antenna device is disassembled and carried, when the antenna device is installed (restored) at the site, it takes time to perform work such as assembling the antenna device and adjusting an azimuth angle and the like of the antenna unit, leading to a demerit.

DETAILED DESCRIPTION

According to one embodiment, a planar antenna device includes a support portion, a first plate-shaped movable portion, a second plate-shaped movable portion, a third plate-shaped movable portion, and a pair of plate-shaped antenna units. The support portion is formed to have a plate shape. The first plate-shaped movable portion is supported by the support portion and is rotatable around a first axial line extending in a thickness direction of the support portion. The second plate-shaped movable portion is supported by the first plate-shaped movable portion and is rotatable around a second axial line extending along a main surface of the support portion. The third plate-shaped movable portion is supported by the second plate-shaped movable portion and is rotatable around a third axial line extending in a thickness direction of the second plate-shaped movable portion. The pair of plate-shaped antenna units is turnably supported by the third plate-shaped movable portion and is switchable between a closed state in which main surfaces of the antenna units are disposed so as to face each other and an open state in which the main surfaces are disposed on the same plane as each other.

Hereinafter, a planar antenna device according to an embodiment will be described with reference to the drawings.

Figure 1:
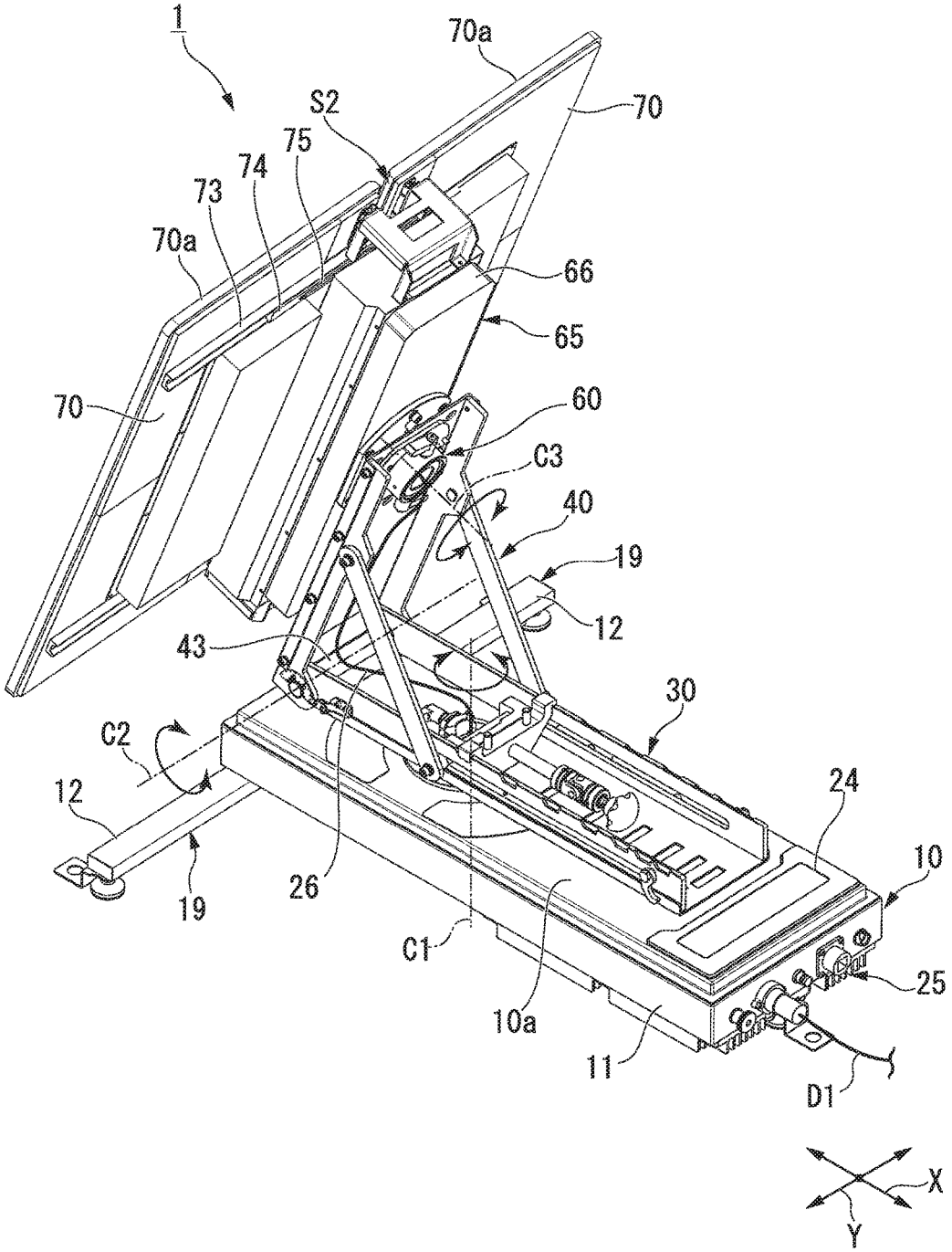
FIG. 1 is a perspective view of a state where a planar antenna device according to an embodiment is installed, seen from the back.

As shown in FIG. 1, according to the present embodiment, there is provided a planar antenna device 1 including a support portion 10 that is formed to have a plate shape, a first plate-shaped movable portion 30 that is supported by the support portion 10 and is rotatable around a first axial line C1 parallel to a thickness direction of the support portion 10, a second plate-shaped movable portion 40 that is supported by the first plate-shaped movable portion 30 and is rotatable around a second axial line C2 parallel to a main surface 10*a* of the support portion 10, a third plate-shaped movable portion 65 that is supported by the second plate-shaped movable portion 40 and is rotatable around a third axial line C3 parallel to a thickness direction of the second plate-shaped movable portion 40, and a pair of plate-shaped antenna units 70 that is turnably supported by the third plate-shaped movable portion 65.

Figure 7:
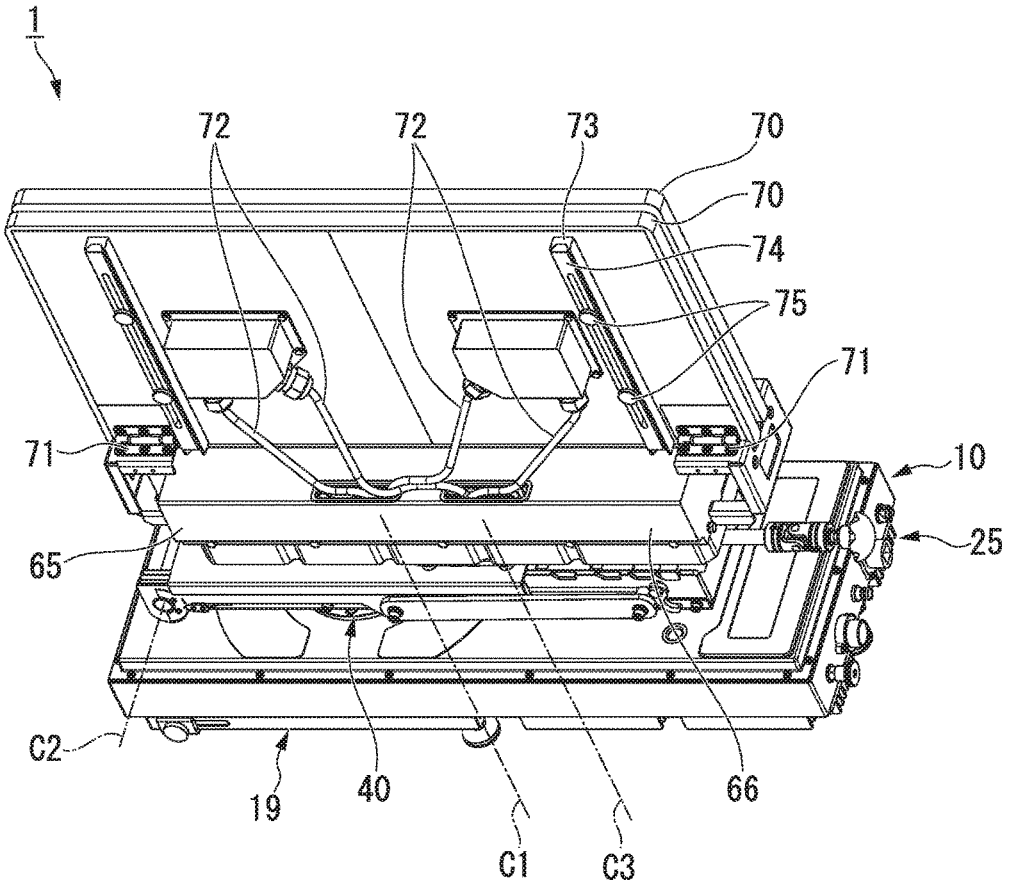
FIG. 7 is a perspective view of a state where the planar antenna device according to the embodiment is folded.
Figure 8:
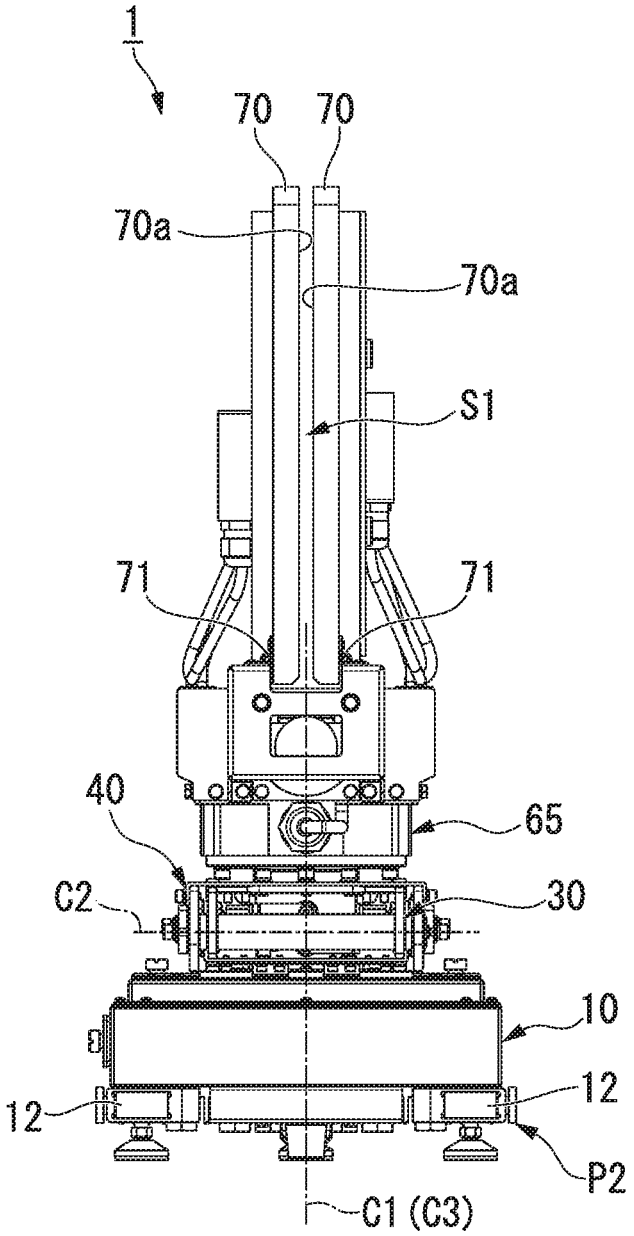
FIG. 8 is a side view of the state where the planar antenna device according to the embodiment is folded.

FIG. 1 shows a state where the pair of plate-shaped antenna units 70 is spread and the planar antenna device 1 is installed at a destination. FIGS. 7 and 8 show a state where the pair of plate-shaped antenna units 70 is closed and the planar antenna device 1 is folded.

Figure 2:
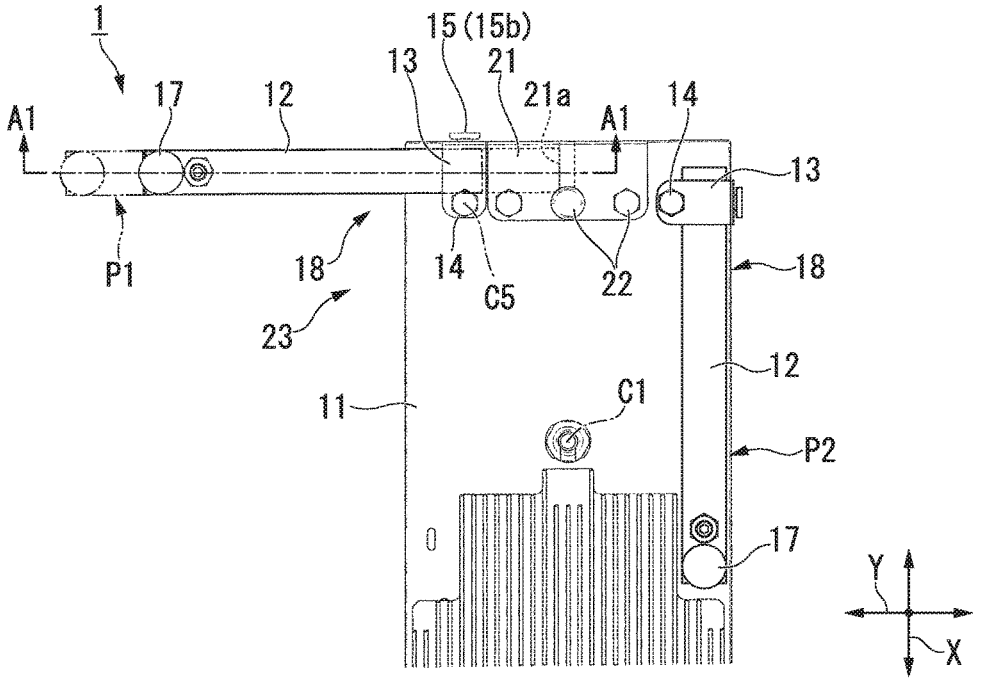
FIG. 2 is a bottom view of the planar antenna device according to the same.
Figure 3:
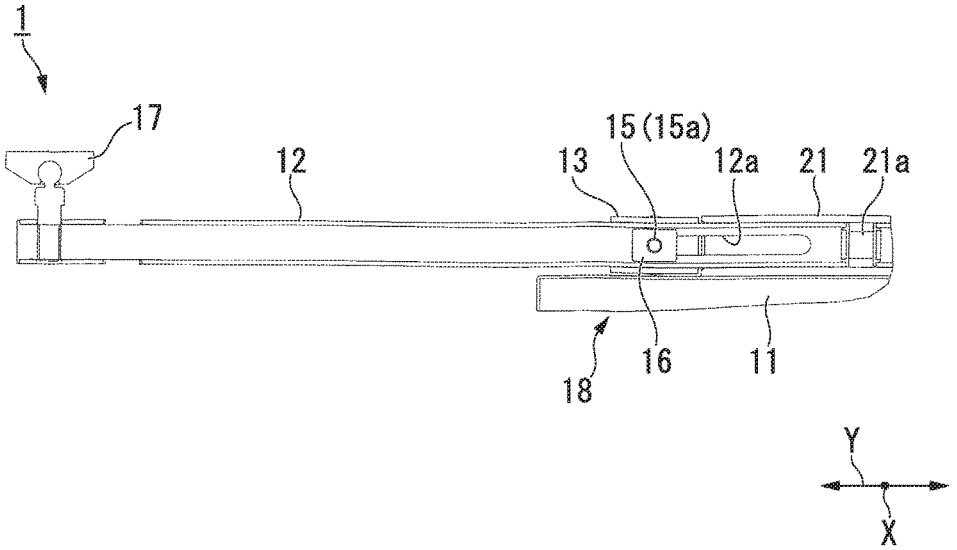
FIG. 3 is a sectional view cut along line A1-A1 in FIG. 2.

As shown in FIGS. 2 and 3, the support portion 10 has a support portion main body 11 which is formed to have a box shape and configures the external shape of the support portion 10, a pair of support members 12 which is rotatably supported on the bottom surface of a first end portion of the support portion main body 11 in a longitudinal direction X, and an IDU (not shown) which is mounted inside the support portion main body 11.

The support portion main body 11 is formed to have a rectangular shape when seen in a direction parallel to the first axial line C1. Although the first axial line C1 is set to be parallel to the thickness direction of the support portion 10, the first axial line C1 may extend in the thickness direction of the support portion 10.

The support members 12 are each formed to have a square-cylindrical shape. A long hole 12*a* extending along the longitudinal direction of the support member 12 is formed on a side surface of the first end portion of the support member 12. The support member 12 is inserted through the inside of a first attachment member 13 which is formed to have a square-cylindrical shape. The first attachment member 13 is supported by a pivot member 14 so as to be rotatable with respect to the support portion main body 11 around a rotary axis C5 substantially parallel (or parallel) to the first axial line C1. A penetration hole (not shown) is formed on the side surface of the first attachment member 13. A shaft portion 15*a* of a fastening screw 15 is inserted through the penetration hole of the first attachment member 13 and the long hole 12*a* of the support member 12. A female screw portion (reference sign omitted) is formed in a clasp 16, and the clasp 16 is disposed inside the support member 12.

That is, a head portion 15*b* of the fastening screw 15 and the clasp 16 are disposed so as to interpose the first attachment member 13 and the support member 12 therebetween. A male screw portion (reference sign omitted) formed in the shaft portion 15*a* of the fastening screw 15 is screwed to the female screw portion of the clasp 16. When the fastening screw 15 and the clasp 16 are loosely screwed, the shaft portion 15*a* of the fastening screw 15 can move inside the long hole 12*a* of the support member 12. Accordingly, the support member 12 can move along the longitudinal direction of the support member 12 with respect to the first attachment member 13.

On the other hand, when the fastening screw 15 and the clasp 16 are tightly screwed, the first attachment member 13 and the support member 12 are clamped by the head portion 15*b* of the fastening screw 15 and the clasp 16. Accordingly, the support member 12 is fixed to the first attachment member 13.

It is preferable that an adjuster 17 for adjusting the height be attached to a second end portion of the support member 12.

The support member 12, the first attachment member 13, the pivot member 14, the fastening screw 15, and the clasp 16 configure an outrigger mechanism 18 which restrains the support portion main body 11 from tilting in a width direction Y. There are provided a pair of the outrigger mechanisms 18 arranged in the width direction Y in the support portion main body 11.

A second attachment member 21 is provided in a part between the first attachment members 13 of the pair of outrigger mechanisms 18 on the bottom surface of the support portion main body 11. The second attachment member 21 is formed to have a square-cylindrical shape and is fixed to the support portion main body 11 by fixing tools 22 such as screws.

The fastening screws 15, the clasps 16, and the second attachment member 21 configure a fixing mechanism 23 fixing the support members 12, which each have moved to a protrusion position P1 (will be described below), with respect to the support portion main body 11.

The second attachment member 21 extends in the width direction Y of the support portion main body 11. A stopper 21*a* is attached to a central portion inside the second attachment member 21 in the width direction Y When seen in the direction parallel to the first axial line C1 as shown in FIG. 2, the outrigger mechanism 18 having such a configuration can move (switch) between the protrusion position P1 at which the support member 12 extends in the width direction Y and the support member 12 protrudes from the support portion main body 11, and an accommodation position P2 at which the support member 12 extends in the longitudinal direction X and is disposed within the contour of the support portion main body 11.

The first end portion of the support member 12 disposed at the protrusion position P1 is inserted into the second attachment member 21 by a user of the planar antenna device 1. The first end portion of the support member 12 is brought into contact with the stopper 21*a* inside the second attachment member 21. The fastening screw 15 and the clasp 16 are tightly screwed, so that the support member 12 at the protrusion position P1 is fixed to the support portion main body 11.

On the other hand, when the fastening screw 15 and the clasp 16 are loosely screwed together and the support member 12 is pulled out from the inside of the second attachment member 21, the support member 12 fixed to the support portion main body 11 is released.

In this manner, the fixing mechanism 23 is switchable between a fixed state in which the support member 12 is fixed to the support portion main body 11 after moving to the protrusion position P1 and a released state in which the fixed support member 12 is released so as to be movable to the accommodation position P2.

The support member 12 at the accommodation position P2 is interlocked with the support portion main body 11 by being fitted thereto utilizing the unevenness.

As shown in FIG. 1, a display unit 24 and an input/output terminal portion 25 are provided in the second end portion of the support portion main body 11 in the longitudinal direction X. The display unit 24 and the terminal portion 25 are connected to the IDU. The display unit 24 displays a measurement result of the field intensity obtained by the IDU, and the like.

The terminal portion 25 is connected to a computer (not shown) via a cable D1. The computer controls the planar antenna device 1.

Figure 4:
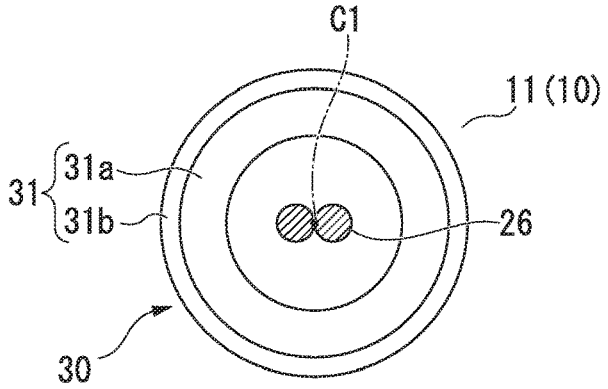
FIG. 4 is a plan view of a first connection portion of the planar antenna device according to the embodiment.

As shown in FIG. 4, the support portion 10 and the first plate-shaped movable portion 30 are connected to each other through a cylinder-shaped first connection portion (connection portion) 31. For example, the first connection portion 31 has an inner tube 31*a* which is attached to the support portion main body 11 of the support portion 10, and an outer tube 31*b* which is attached to the first plate-shaped movable portion 30 and is provided coaxially with the inner tube 31*a*. The outer tube 31*b* covers the outer circumferential surface of the inner tube 31*a*. The first connection portion 31 is provided on the first axial line C1. The outer tube 31*b* can move in only the circumferential direction of the inner tube 31*a* with respect to the inner tube 31*a* using a known bearing mechanism or the like.

A wiring portion 26 connected to the IDU is inserted through the inside of a tube hole of the inner tube 31*a* of the first connection portion 31.

Figure 5:
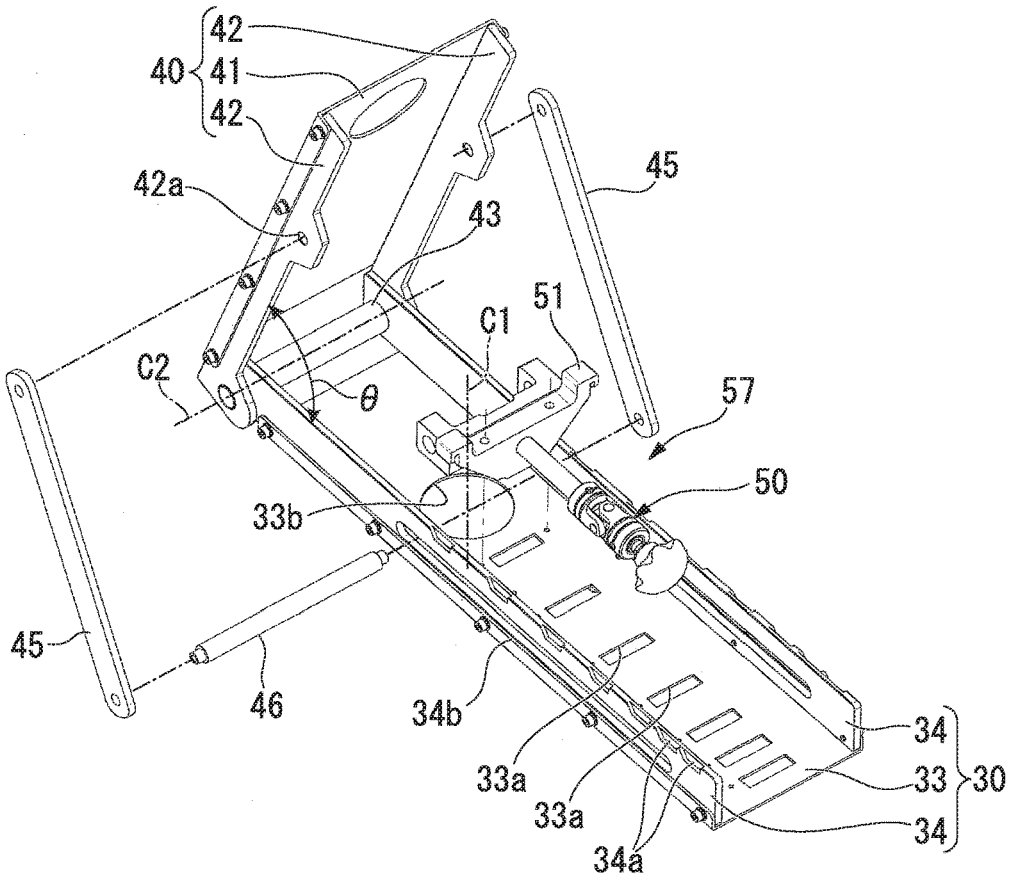
FIG. 5 is an exploded perspective view of a first plate-shaped movable portion and a second plate-shaped movable portion of the planar antenna device according to the embodiment.

As shown in FIG. 5, the first plate-shaped movable portion 30 has a movable portion main body 33, and wall portions 34 which are respectively erected from end portions of the movable portion main body 33 in the width direction. FIG. 5 shows only a main portion of the configuration. Screws, nuts, and the like are not shown.

The movable portion main body 33 is formed to have a rectangular shape when seen in the direction parallel to the first axial line C1. A plurality of long holes 33*a* is formed in the movable portion main body 33 along the longitudinal direction of the movable portion main body 33. The plurality of long holes 33*a* is formed separately from each other. The distance between the long holes 33*a* adjacent to each other in the longitudinal direction becomes shorter from the first end portion toward the second end portion in the longitudinal direction of the movable portion main body 33.

A penetration hole 33*b* for allowing the wiring portion 26 to be inserted through is formed in a part closer to the first end portion than the plurality of long holes 33*a* in the movable portion main body 33. A plurality of cut-outs 34*a* is formed at an upper edge of each wall portion 34 along the longitudinal direction of the movable portion main body 33. The cut-outs 34*a* are formed so as to respectively correspond to the long holes 33*a*. That is, the distance between the cut-outs 34*a* adjacent to each other in the longitudinal direction becomes shorter from the first end portion toward the second end portion in the longitudinal direction of the movable portion main body 33.

A long hole 34*b* extending in the longitudinal direction of the movable portion main body 33 is formed in the wall portion 34.

The movable portion main body 33 and a pair of the wall portions 34 are formed of metal plates or the like.

The second plate-shaped movable portion 40 has a movable portion main body 41, and wall portions 42 which are respectively erected from end portions of the movable portion main body 41 in the width direction. The movable portion main body 41 is formed to have a rectangular shape. A penetration hole 42*a* is formed in a central portion of each wall portion 42 in the longitudinal direction of the movable portion main body 41.

The end portions of the pair of wall portions 34 in the first plate-shaped movable portion 30 and the end portions of the pair of wall portions 42 in the second plate-shaped movable portion 40 are rotatably supported via a pivot member 43.

The first end portion of a link member 45 is turnably connected to the penetration hole 42*a* of each wall portion 42 in the second plate-shaped movable portion 40. A connecting bar 46 is inserted through the long hole 34*b* of each wall portion 34 in the first plate-shaped movable portion 30. An end portion of the connecting bar 46 is connected to the second end portion of the link member 45.

Here, an angle of the second plate-shaped movable portion 40 around the second axial line C2 with respect to the first plate-shaped movable portion 30 is referred to as a support angle θ. According to such a configuration including the first plate-shaped movable portion 30, the second plate-shaped movable portion 40, the link members 45, and the connecting bar 46, when the connecting bar 46 is moved along the longitudinal direction of the movable portion main body 33, the support angle θ can be adjusted.

The second axial line C2 serves as a central axial line of the pivot member 43. Although the second axial line C2 is set to be parallel to the main surface 10*a* of the support portion 10, the second axial line C2 may extend along the main surface 10*a* of the support portion 10.

Figure 6:
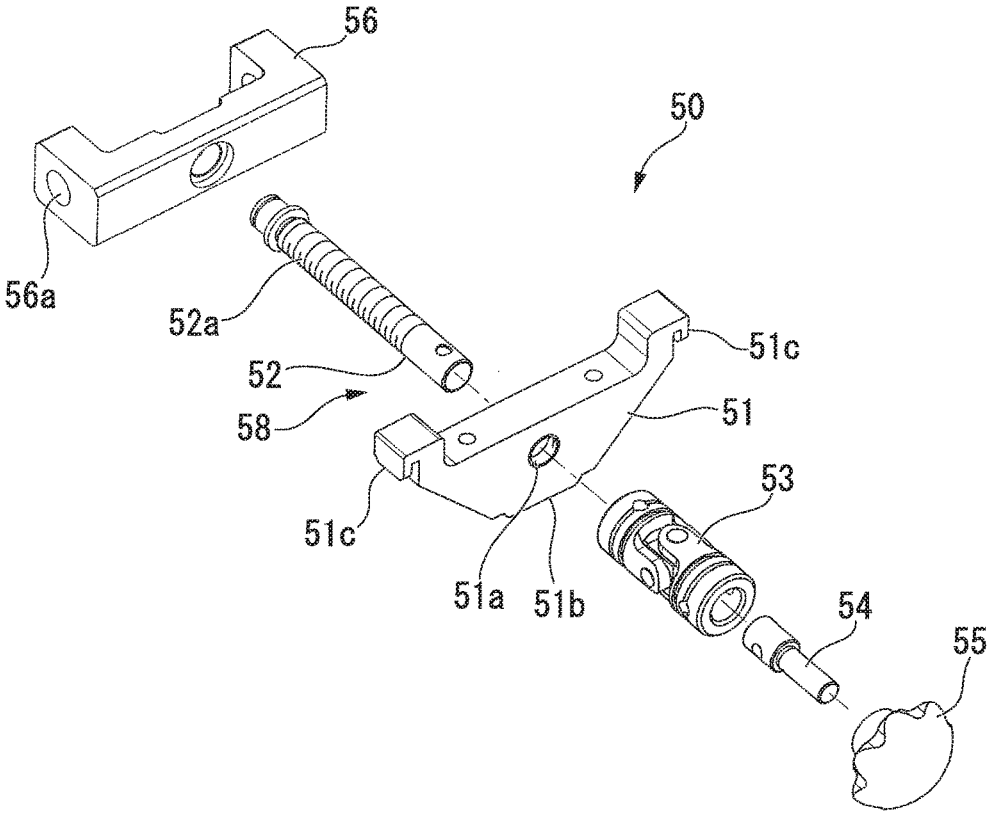
FIG. 6 is an exploded perspective view of an elevation angle adjustment unit of the planar antenna device according to the embodiment.

An elevation angle adjustment unit 50 shown in FIG. 6 engages with the first plate-shaped movable portion 30 and the connecting bar 46.

The elevation angle adjustment unit 50 has an adjustment unit main body 51 and a shaft-shaped member 52 in which a male screw portion 52*a* screwed to a female screw portion 51*a* formed in the adjustment unit main body 51 is formed on an outer circumferential surface.

The female screw portion 51*a* of the adjustment unit main body 51 is screwed to the male screw portion 52*a* in an intermediate portion of the shaft-shaped member 52 in the longitudinal direction. A projection portion 51*b* engaging with each of the long holes 33*a* in the movable portion main body 33 is formed on the bottom surface of the adjustment unit main body 51. Projection portions 51*c* engaging with each of the cut-outs 34*a* in the wall portions 34 are respectively formed in end portions of the adjustment unit main body 51 in the width direction.

A handle 55 is connected to the first end portion of the shaft-shaped member 52 via a rotary joint 53 and a first interlocking member 54. When the handle 55 is rotated around the axial line of the first interlocking member 54, the position of the male screw portion 52*a* to be screwed to the female screw portion 51*a* varies. The shaft-shaped member 52 moves in the longitudinal direction of the shaft-shaped member 52 with respect to the adjustment unit main body 51.

Furthermore, a second interlocking member 56 is connected to the second end portion of the shaft-shaped member 52. When the shaft-shaped member 52 moves in the longitudinal direction of the shaft-shaped member 52 while rotating, the second interlocking member 56 moves in the longitudinal direction of the shaft-shaped member 52 without rotating.

A penetration hole 56*a* is formed in the second interlocking member 56, and the connecting bar 46 is inserted through the penetration hole 56*a*.

The projection portion 51*b* and a pair of the projection portions 51*c* in the adjustment unit main body 51, and the long holes 33*a* and the cut-outs 34*a* in the first plate-shaped movable portion 30 configure a coarse adjustment unit 57 (refer to FIG. 5). The female screw portion 51*a* of the adjustment unit main body 51 and the male screw portion 52*a* of the shaft-shaped member 52 configure a fine adjustment unit 58.

The coarse adjustment unit 57 of the elevation angle adjustment unit 50 having such a configuration shifts the position where the projection portion 51*b* and the pair of projection portions 51*c* respectively engage with the long hole 33*a* and the cut-outs 34*a* of the first plate-shaped movable portion 30, in the longitudinal direction of the movable portion main body 33. Then, for example, the above-described support angle θ is adjusted to 10° (first angle), 20° (second angle), 30°, and so on to 80° in stages. The angle of 20° is an angle greater than 10°, and the angle 30° is an angle greater than 20°.

On the other hand, the fine adjustment unit 58 of the elevation angle adjustment unit 50 successively adjusts the support angle θ by varying the position where the female screw portion 51*a* and the male screw portion 52*a* are screwed together. That is, the fine adjustment unit 58 adjusts the support angle θ on a scale smaller than 10° which is the difference between the second angle and the first angle.

The coarse adjustment unit 57 and the fine adjustment unit 58 can adjust the support angle θ independently from each other.

As shown in FIG. 1, the second plate-shaped movable portion 40 and the third plate-shaped movable portion 65 are connected to each other through a second connection portion (connection portion) 60 having a configuration similar to that of the above-described first connection portion 31. The second connection portion 60 is provided on the third axial line C3.

The wiring portion 26 inserted through the inside of the tube hole of the first connection portion 31 is laid around in the vicinity of the pivot member 43 and then is inserted through the inside of the tube hole of the second connection portion 60. The wiring portion 26 is connected to an ODU (will be described below) of the third plate-shaped movable portion 65.

The third plate-shaped movable portion 65 has a movable portion main body 66 and the ODU (not shown). The movable portion main body 66 has a box shape and configures the external shape of the third plate-shaped movable portion 65. The ODU is mounted inside the movable portion main body 66.

Although the third axial line C3 is set to be parallel to the thickness direction of the second plate-shaped movable portion 40, the third axial line C3 may extend in the thickness direction of the second plate-shaped movable portion 40.

In the present embodiment, each of the plate-shaped antenna units 70 has a substrate (not shown) and can transmit and receive electromagnetic waves.

As shown in FIG. 7, a second main surface of the movable portion main body 66 and the above-described pair of plate-shaped antenna units 70 are connected to each other via a torque hinge 71. For example, the torque hinge 71 adjusts torque generated between the movable portion main body 66 and the plate-shaped antenna units 70. Accordingly, the torque hinge 71 can temporarily hold the position of the pair of plate-shaped antenna units 70 in a state of being disposed on the same plane (open state). After the pair of plate-shaped antenna units 70 is temporarily held on the same plane, the pair of plate-shaped antenna units 70 can be firmly held on the same plane using plane holding guides 73, plane holding rails 74, and fastening screws 75 shown in FIGS. 1 and 7.

The pair of plate-shaped antenna units 70 is switchable between a closed state in which main surfaces 70*a* are disposed so as to face each other as shown in FIG. 8, and the open state in which the main surfaces 70*a* are spread so as to be disposed on the same plane as each other as shown in FIG. 1.

A space S1 is formed between the plate-shaped antenna units 70 in the closed state shown in FIG. 8. It is preferable that the space S1 have a size large enough for a finger to be hooked on the pair of plate-shaped antenna units 70 (for example, approximately 5 mm to 15 mm).

A space S2 is also formed between the plate-shaped antenna units 70 in the open state shown in FIG. 1. Due to the space S2 formed therein, the pair of plate-shaped antenna units 70 switching between the open state and the closed state is less likely to interfere with each other.

Each of the plate-shaped antenna units 70 is connected to the ODU through an auxiliary wiring portion 72 (refer to FIG. 7).

As shown in FIGS. 7 and 8, when the planar antenna device 1 is folded, the first axial line C1 and the third axial line C3 are on the same plane. The first axial line C1 and the third axial line C3, and the second axial line C2 are at positions oblique to each other.

When the planar antenna device 1 is folded, the support portion 10, the first plate-shaped movable portion 30, and the second plate-shaped movable portion 40 are disposed so as to overlap each other in a state of being aligned in the longitudinal direction. The pair of plate-shaped antenna units 70 is in the closed state.

When the planar antenna device 1 is folded, the support members 12 are at the accommodation positions P2.

For example, the planar antenna device 1 having such a configuration weighs approximately 20 kg and can be easily carried by one person on his/her back.

Subsequently, a procedure of carrying and installing such a planar antenna device 1 will be described.

Figure 9:
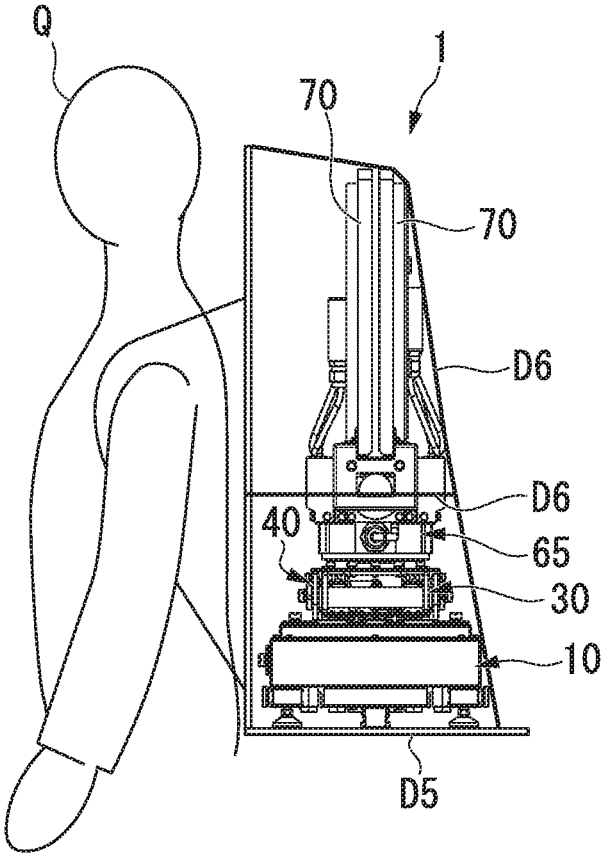
FIG. 9 is a side view of a state where the planar antenna device according to the embodiment is carried on a user's back using a back-carrier.

As shown in FIG. 9, a user Q places the planar antenna device 1 in a folded state, on a back-carrier D5. At this time, the support members 12 are at the accommodation positions P2, and the fixing mechanism 23 is in the released state.

The planar antenna device 1 in the folded state has a small external shape compared to that of the planar antenna device 1 in an installed state, so that the planar antenna device 1 can be easily placed on the back-carrier D5. The planar antenna device 1 is fixed to the back-carrier D5 using a fixing tool D6 such as a belt.

Figure 10:
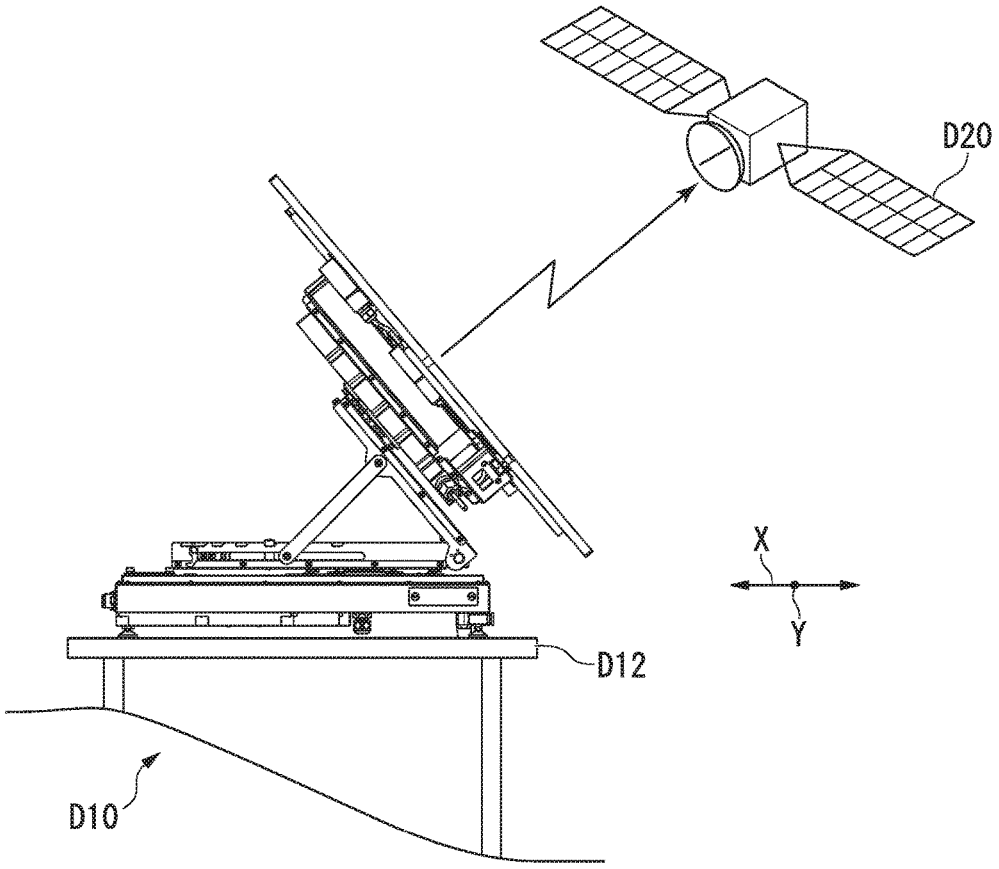
FIG. 10 is a view of a state where the planar antenna device according to the embodiment is installed at a destination.

The user Q carries the back-carrier D5 on his/her back and takes the planar antenna device 1 to a destination D10 such as a disaster-stricken area shown in FIG. 10.

A known support table D12 is installed such that the top surface of the support table D12 becomes parallel to the horizontal surface. The pair of support members 12 is set at the protrusion positions P1, the fixing mechanism 23 is caused to be in the fixed state, and the positions of the support members 12 which have moved to the protrusion positions P1 are fixed. The support portion 10 of the planar antenna device 1 is placed on the top surface of the support table D12. The length of the support portion main body 11 in the width direction Y increases due to the pair of support members 12, and the planar antenna device 1 is less likely to be affected by the wind or the like and to tilt in a first orientation or a second orientation in the width direction Y.

An azimuth angle (AZ), an elevation angle (EL), and a polarization angle (POL) are obtained based on the latitude and the longitude of the destination D10, the position of a target communication satellite D20, and the like.

The user Q approximately sets the elevation angle using the coarse adjustment unit 57. The user Q hooks their finger into the space S1 between the plate-shaped antenna units 70 in the closed state such that the pair of plate-shaped antenna units 70 turns into the open state from the closed state. Since the space S1 is formed between the plate-shaped antenna units 70 in the closed state, the user Q can hook their finger easily on each of the plate-shaped antenna units 70.

Since the pair of plate-shaped antenna units 70 and the movable portion main body 66 of the third plate-shaped movable portion 65 are connected to each other via the torque hinge 71, each of the plate-shaped antenna units 70 is temporarily held in the open state.

For example, the user Q detects the southeast direction using an azimuth magnet or the like and sets the planar antenna device 1 to be oriented in the southeast direction. The computer and the planar antenna device 1 are connected to each other via the cable D1. The planar antenna device 1 is actuated.

When the computer is operated, the pair of plate-shaped antenna units 70 receives radio waves, and the display unit 24 displays the field intensity of the radio waves measured by the IDU. While the field intensity displayed by the display unit 24 is checked, the angle of the first plate-shaped movable portion 30 around the first axial line C1 with respect to the support portion 10, that is, the azimuth angle is adjusted such that the field intensity increases. Since the wiring portion 26 is inserted through the inside of the tube hole of the first connection portion 31, even if the first plate-shaped movable portion 30 is rotated around the first axial line C1, the distance from the first connection portion 31 to the second plate-shaped movable portion 40 does not change.

The user Q grips and rotates the handle 55 and performs a fine adjustment of the elevation angle using the fine adjustment unit 58. Compared to a case of adjusting the elevation angle entirely depending on the handle 55, the elevation angle can be easily adjusted.

The third plate-shaped movable portion 65 is rotated around the third axial line C3 with respect to the second plate-shaped movable portion 40, thereby adjusting the polarization angle.

Communication with the communication satellite D20 is performed using the planar antenna device 1 installed as described above.

As described above, according to the planar antenna device 1 of the present embodiment, the first plate-shaped movable portion 30 is rotatable with respect to the support portion 10. The second plate-shaped movable portion 40 is rotatable with respect to the first plate-shaped movable portion 30, and the third plate-shaped movable portion 65 is rotatable with respect to the second plate-shaped movable portion 40. Moreover, the pair of plate-shaped antenna units 70 is switchable between the closed state and the open state.

Since the planar antenna device 1 in the folded state has a small external shape compared to that of the planar antenna device 1 in the installed state, the planar antenna device 1 can be easily carried by utilizing the back-carrier D5 or the like.

There is no need to assemble the planar antenna device 1, so that the planar antenna device 1 can be easily installed by unfolding the planar antenna device 1 in the folded state and adjusting the azimuth angle, the elevation angle, and the polarization angle.

The support portion 10 has the support portion main body 11 and the support members 12. Each support member 12 can move between the protrusion position P1 and the accommodation position P2. When the support members 12 move to the protrusion positions P1, the planar antenna device 1 in the installed state can be restrained from tilting in the width direction Y of the support portion 10.

When the positions of the support members 12 are fixed by the fixing mechanism 23, the support members 12 which have moved to the protrusion positions P1 are less likely to move from the protrusion positions P1 to other positions.

When the planar antenna device 1 includes the coarse adjustment unit 57 and the fine adjustment unit 58, the elevation angle can be easily and precisely adjusted.

The space S1 is formed between the plate-shaped antenna units 70 in the closed state. Therefore, a user Q can hook their finger easily on the pair of plate-shaped antenna units 70 in the closed state.

The third plate-shaped movable portion 65 and the plate-shaped antenna units 70 are connected to each other via the torque hinge 71. Accordingly, it is possible to hold the plate-shaped antenna units 70 at an arbitrarily open angle with respect to the third plate-shaped movable portion 65.

The wiring portion 26 is inserted through the inside of the tube hole of the first connection portion 31 provided on the first axial line C1. Therefore, even if the first plate-shaped movable portion 30 is rotated around the first axial line C1, the distance from the first connection portion 31 to the second plate-shaped movable portion 40 does not change (the lead length of the wiring portion 26 does not change). Accordingly, the wiring portion 26 is less likely to be caught in the second plate-shaped movable portion 40 or the like.

In the present embodiment, although the planar antenna device 1 includes the support members 12 and the fixing mechanism 23, for example, when the planar antenna device 1 is less likely to tilt in the width direction Y of the support portion 10, the planar antenna device 1 does not have to include the support members 12 and the fixing mechanism 23.

The planar antenna device 1 does not have to include the coarse adjustment unit 57 and the fine adjustment unit 58. The second plate-shaped movable portion 40 may be supported by a third connection portion which has a mechanism similar to that of the first connection portion 31, so that the second plate-shaped movable portion 40 is rotatable around the second axial line C2 with respect to the first plate-shaped movable portion 30. In this case, the third connection portion is provided on the second axial line C2.

When a grip or the like is provided in each of the plate-shaped antenna units 70 and the pair of plate-shaped antenna units 70 can switch from the closed state to the open state by operating the grip, the space S1 does not have to be formed between the plate-shaped antenna units 70 in the closed state.

The third plate-shaped movable portion 65 and the plate-shaped antenna units 70 may be connected to each other via an ordinary hinge which does not adjust torque, instead of the torque hinge 71.

The wiring portion 26 does not have to be inserted through the inside of the tube hole of the first connection portion 31 and may be laid around in the vicinity of the first axial line C1.

According to at least one of the embodiments described above, when the first plate-shaped movable portion 30, the second plate-shaped movable portion 40, and the third plate-shaped movable portion 65 are respectively rotatable around the first axial line C1, the second axial line C2, and the third axial line C3, and when the pair of plate-shaped antenna units 70 is switchable between the closed state and the open state, it is possible to facilitate carrying work and installation work.

Some embodiments of the present invention have been described. However, the embodiments are presented as examples and are not intended to limit the scope of the invention. The embodiments can be realized in various other aspects. Various types of omission, replacement, and changes can be made without departing from the gist of the invention. The embodiments and modifications thereof are included in the scope and the gist of the invention, and similarly included in the invention disclosed in the claims and the scope equivalent thereto.

What is claimed is:

1. A planar antenna device comprising:

a support portion that is formed to have a plate shape;

a first plate-shaped movable portion that is supported by the support portion and is rotatable around a first axial line extending in a thickness direction of the support portion;

a second plate-shaped movable portion that is supported by the first plate-shaped movable portion and is rotatable around a second axial line extending along a main surface of the support portion;

a third plate-shaped movable portion that is supported by the second plate-shaped movable portion and is rotatable around a third axial line extending in a thickness direction of the second plate-shaped movable portion; and a pair of plate-shaped antenna units that is turnably supported by the third plate-shaped movable portion and is switchable between a closed state in which main surfaces of the antenna units are disposed so as to face each other and an open state in which the main surfaces are disposed on the same plane as each other.

2. The planar antenna device according to claim 1, wherein the support portion includes a support portion main body which is formed to have a box shape, and a support member which is rotatably supported by the support portion main body around a rotary axis parallel to the first axial line and is movable between a protrusion position protruding from the support portion main body and an accommodation position disposed within a contour of the support portion main body, when seen in a direction parallel to the first axial line.

3. The planar antenna device according to claim 2, further comprising:

a fixing mechanism that is switchable between a fixed state in which the support member is fixed to the support portion main body after moving to the protrusion position and a released state in which the fixed support member is released.

4. The planar antenna device according to claim 1, further comprising:

a coarse adjustment unit that adjusts a support angle which is an angle of the second plate-shaped movable portion around the second axial line with respect to the first plate-shaped movable portion in stages between a first angle and a second angle greater than the first angle; and a fine adjustment unit that adjusts the support angle on a scale smaller than a difference between the second angle and the first angle.

5. The planar antenna device according to claim 1, wherein a space is formed between the plate-shaped antenna units in the closed state.

6. The planar antenna device according to claim 1, wherein the third plate-shaped movable portion and the plate-shaped antenna unit are connected to each other via a torque hinge.

7. The planar antenna device according to claim 1, further comprising:

a cylindrical connection portion that is provided on at least one of the first axial line, the second axial line, and the third axial line; and a wiring portion that is inserted through the inside of a tube hole of the connection portion.

* * * * *